US005838806A

United States Patent [19]

Sigwanz et al.

[11] Patent Number: 5,838,806

[45] Date of Patent: Nov. 17, 1998

[54] METHOD AND CIRCUIT FOR PROCESSING DATA, PARTICULARLY SIGNAL DATA IN A DIGITAL PROGRAMMABLE HEARING AID

[75] Inventors: Ullrich Sigwanz, Erlangen; Fred Zoels, Altenthann, both of Germany

[73] Assignee: Siemens Aktiengesellschaft, Munich, Germany

[21] Appl. No.: 818,180

[22] Filed: Mar. 14, 1997

[30] Foreign Application Priority Data

Mar. 27, 1996 [EP] European Pat. Off. ..... 96104903

[51] Int. Cl.[6] ..... H04R 25/00

[52] U.S. Cl. ..... 381/312; 381/320; 381/321

[58] Field of Search ..... 381/23.1, 60, 68, 381/68.2, 68.4, 61, 71.13, 312, 320, 321

[56] References Cited

U.S. PATENT DOCUMENTS 4,991,218 2/1991 Krammer ..... 381/61
5,590,206 12/1996 An et al. ..... 381/71.13
5,604,812 2/1997 Meyer ..... 381/68.2

FOREIGN PATENT DOCUMENTS 0 339 819 11/1989 European Pat. Off. .
OS 36 22 205 1/1987 Germany .

*Primary Examiner*—Huyen Le
*Attorney, Agent, or Firm*—Hill & Simpson

[57] ABSTRACT

In a method for processing data, in particular signal data in a programmable digital hearing aid, first a data memory is searched to locate a stored comparison input value corresponding with a current, incoming input data value E which satisfies a comparison condition. Subsequently the data memory is searched for a stored output value allocated in a predetermined manner now-identified to the stored input data value via a characteristic function. Subsequently the determined comparison output value is emitted as an output value, and the procedure is repeated for further incoming input data values. In a circuit for processing data, particularly signal data, in a programmable hearing aid, the incoming input data value is supplied via a data input/output unit of a processor to a comparison element for determining whether there exists a stored input value corresponding to the current input data value by satisfying a comparison condition. The circuit also includes a data base in which the allocated input and output values are stored.

21 Claims, 1 Drawing Sheet

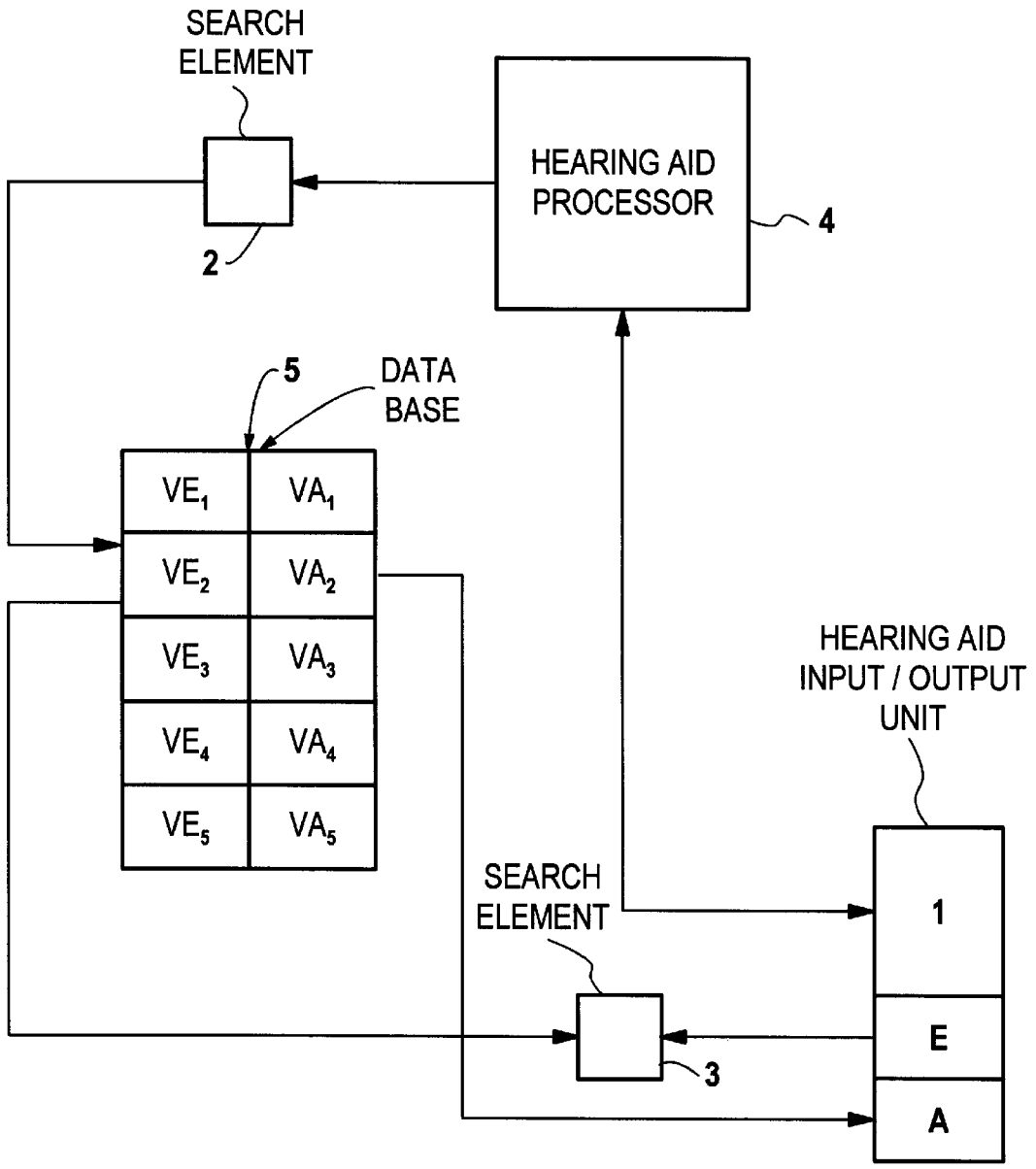
SEARCH ELEMENT
HEARING AID PROCESSOR
4
2
5
DATA BASE
VE1
VA1
VE2
VA2
VE3
VA3
VE4
VA4
VE5
VA5
HEARING AID INPUT / OUTPUT UNIT
SEARCH ELEMENT
1
E
3
A

METHOD AND CIRCUIT FOR PROCESSING DATA, PARTICULARLY SIGNAL DATA IN A DIGITAL PROGRAMMABLE HEARING AID

BACKGROUND OF THE INVENTION

1. Field of the Invention

The invention concerns a method and a circuit for processing data, in particular signal data, in a programmable digital hearing aid.

2. Description of the Prior Art

In the processing of data, particularly signal data, in digital hearing aids, input values are acquired and subjected to a functional algorithm adapted to the current hearing situation or signal characteristic. Output values allocated to the input values are thus calculated using the processor of the hearing aid. This calculation occupies virtually the entire operating capability of the processor.

In such known hearing aids, therefore, extensive and desirable further tasks of the processor (e.g. recognition and classification of the current hearing situation, signal preprocessing and post-processing, etc.) can be carried out only to a significantly reduced extent during the calculation of the data output values from the data input values to be processed.

SUMMARY OF THE INVENTION

An object of the present invention is to provide a method and a circuit for a programmable digital hearing aid, which enable a significantly reduced fraction of the capacity of the processor of the digital hearing aid to be used during the processing of signals.

The above object is achieved in accordance with the principles of the present invention in a programmable digital hearing aid, and a method for operating same, wherein a number of predetermined input values are stored in a memory in a manner so as to be respectively allocated to predetermined output values also stored in the memory, wherein, upon receipt of a current input value by the hearing aid, the hearing aid processor conducts a search of the memory in order, first, to locate a stored input value, if any, which satisfies a comparison condition relative to the current input value. If a stored input value which satisfies the comparison condition is found, the output value allocated thereto is then emitted. This procedure is then repeated for each further incoming input value to the hearing aid.

The allocation of the output values to the respective input values in the data memory can proceed by means of a calculated function. This function can be one or more of the functions which, in a conventional hearing aid processor, would have to be undertaken in real time by the processor each time an incoming input value was received. As noted above, the necessity of repeatedly undertaking such relatively complicated calculations occupies virtually all of the processor's operating capability, and thus the processor, in conventional hearing aids, is normally not available to perform further tasks, as would be desirable.

The inventive method avoids a calculation of input data values to be processed, which calculation is a source of the above-described disadvantages, and instead performs a search and identification of stored comparison input data values, which are associated with the input data value via a comparison condition. During this search, carried out by means of address arithmetic, the processor of the digital hearing aid is not occupied by calculation tasks.

The inventive circuit has a unit for data input/output, a search element for the determination of the comparison input data value that corresponds with the input data value, a comparison element for determining whether the comparison input value corresponding with the input data value via the predetermined comparison condition is present, as well as a processor for controlling the aforementioned elements and units.

The search element can be constructed as a separate table pointer control, stored externally from the processor, so that the processor is unburdened during the search for the respective comparison input value(s), and is kept free for further tasks.

As a circuit variant, unchangeable fixed memories (e.g. ROM or PROM) are provided for storing the comparison input data values, comparison output data values, and respective pointer addresses.

In a circuit variant which allows variation, overwriteable fixed memories (e.g. EPROM or EEPROM) are provided to permit frequent changing of the stored data as needed.

DESCRIPTION OF THE DRAWINGS

The single FIGURE is a schematic block diagram of an exemplary embodiment of a digital hearing aid constructed and operating in accordance with the principles of the present invention.

DESCRIPTION OF THE PREFERRED EMBODIMENTS

In the inventive method, a number of different one-dimensional or multidimensional connected data sets of comparison input values and comparison output values are calculated before they are entered into the memory of the digital hearing aid. In the memory, the data sets are then available as completely calculated data values, having only to be fetched, in the course of a search relating to the respective input data value.

In contrast to the conventional, and often multiply repeated, constantly renewed calculation of output values based on (identical) input values, in the inventive method and circuit access takes place to comparison input values calculated and allocated only once, as well as to comparison output values determined by means of search methods explained below.

An arbitrary number of complex characteristic functions connects the respective comparison input values with the allocated comparison output values, so that, with a minimal demand on the capacity of the processor, an outstanding complexity is enabled, as is data processing or signal processing satisfying the highest quality demands.

For the rapid determination of the comparison input values based on one or several given input data values, it is desirable to store the comparison input values in an easily searchable fashion, in a monotonously increasing or decreasing sequence.

In the case of a direct addressability of the comparison input values, the latter can be determined particularly rapidly.

Given comparison input values stored in a monotonic sequence, the sought comparison input value can be determined particularly rapidly by the use of a binary search method.

If for this purpose the numbers 1–1023 are, for example, stored as comparison input values, the first search step according to the binary search method is to query whether the comparison input value to be determined is the number 512. If it should turn out that the comparison input value to be determined is smaller, as the next query it is investigated whether the determined value is 256. If the sought comparison input value is greater than 256, the just-queried search value 256 is increased by the number 128; it is thus queried whether the sought comparison input value is the number 384.

The respective addressing unit for finding the sought comparison input value is thus incremented or decremented by powers of two.

In another variant of the method, comparison input values are determined according to an M-path search method. The data base of comparison input values, ordered in a monotonously rising or falling manner, is subdivided into M blocks. Each block has a smallest and a largest comparison input value. In a first search step, it is determined in which block the sought comparison input value is located. Further searching thereupon takes place in this block in sequential or binary fashion.

A subdivision of the comparison input values into different block groups can be particularly useful if the different block groups are connected with different characteristic values that describe the input data value to be processed. Thus, for example, blocks of comparison input data values can be formed that are concentrated on the signal processing of signal data with a high environmental noise level (e.g. in street traffic).

In addition, other comparison input data values can be combined into an additional block for the purpose of processing speech data or song data.

The input data value connected with additional characteristic values (e.g. with respect to the environment situation) is preferably supplied to a determined block of comparison input data values, whereby the sought comparison input data value, adapted to the respective hearing situation, can be found particularly rapidly.

Given a comparison input data value successfully determined according to the respective search method, the associated comparison output data value can be allocated particularly easily, if the latter is stored and can be fetched parallel to the respective comparison input data value.

Given a desired connection of several comparison input data values (that were, for example, placed into relation with the input data value itself, as well as with additional characteristic values of the input data value), the associated comparison output data value(s) can also be determined by means of an addressing based on the determined comparison input data value, using a pointer address.

By means of the determined comparison input value(s), the respective target address can be formed, and thus the comparison output data value, or several comparison output data values, adapted to the particular signal and hearing situation, can be determined.

For finding comparison (stored) input data values on the basis of current, incoming input data values, a predetermined comparison condition must be satisfied vis-a-vis the incoming input data value and one of the stored input data values. In the simplest case, the comparison (stored) condition can be that a comparison input data value to be sought is regarded as found if it is identical with the present input data value.

For further accelerating the search method, the comparison condition can be less strict in that comparison input values can also be reported as "found" if a predetermined (small) deviation from the basis input data value is maintained. By this means, the search times are shortened with only a small loss of precision in processing.

By means of reversible storing of the comparison input data values and/or comparison output data values and/or respective pointer addresses, given a change in the hearing characteristic of the user of the hearing aid, or for adaptation to particular frequently occurring hearing situations, values derived from the respective new characteristic functions can be stored at any time in the digital hearing aid, so that a high degree of variability is achieved.

A storage of the respective comparison input values and corresponding comparison output values can ensue in the one-dimensional case in tables and in the multi-dimensional case in matrices (with N numbers and in M columns).

By calling the respective table position, or the address of the respective matrix element, the respective elements can be determined reliably and directly.

In addition, in a further variant of the method, the size region from which the comparison input values that are sought and are found originate, is regularly determined. This makes it no longer necessary to search the entire set of comparison input values during a protracted stay by the user in a particular environment and hearing situation, and instead allows the search to begin at the comparison input value that was likewise determined in the previous search.

Thus, in a hearing situation that remains constant, a particularly rapid finding of the comparison input values is ensured.

As a success report, in a variant of the method, after finding the respective comparison input data value a ready bit is set, causing the search process for further comparison input values to be terminated. As an alternative to this, an interrupt can be triggered.

In the exemplary embodiment of the inventive hearing aid circuit shown in the FIGURE, a processor 4 is connected with a data input/output 1. The input/output unit 1 supplies an input data value E to be processed to the processor 4. Via a search element 2, a data base 5 in the form of a data memory table or matrix is now searched for comparison input values VE that fulfill the comparison queried by the comparison element 3. The data base 5 is thus searched for matching comparison input values VE according to one of the described search methods. Upon determination by the comparison element 3 that the matching comparison input value VE was found (i.e. $VE_2$ in the present case), the associated comparison output value ($VA_2$ in the present case) is allocated to the input data value E, originally to be processed, as output data value A in the data input/output unit 1.

The next following input data value E is thereupon called by the unit 1, and associated comparison input values VE and comparison output values VA are determined in the same manner.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for processing a plurality of successive incoming input data values in a programmable digital hearing aid to obtain respective output data values therefrom, comprising the steps of:

(a) providing a hearing aid having a hearing aid housing adapted to be worn at an ear;

(b) for a plurality of different input values, calculating, externally of said hearing aid housing, a plurality of respective output values using a selected characteristic function, and storing said plurality of input values in a data memory in said hearing aid housing as a plurality of stored input values and storing the plurality of respective output values in said data memory, allocated to said stored input values, as a plurality of stored output values;

(c) upon receipt of a current, incoming input data value by said hearing aid, searching said data memory, comprising said stored input values with said incoming input data value employing a comparison condition, said comparison condition being selected from the group consisting of one of said stored input values being identical to said incoming input data value, and one of said stored input values being within a predetermined deviation from said incoming input data value;

(d) after finding said one of said stored input values, searching said data memory for one of said stored output values respectively allocated to said one of said stored input values;

(e) emitting said one of said stored output values as an output data value; and (f) repeating steps (c), (d) and (e) for each further incoming input data value.

2. A method as claimed in claim 1 wherein step (b) is further defined by storing said input values in said data memory in a monotonously changing sequence.

3. A method as claimed in claim 1 wherein step (b) is further defined by storing said input values in said data memory so as to be directly addressable.

4. A method as claimed in claim 1 wherein step (c) is further defined by searching said data memory for one of said stored input data values comprises a binary search.

5. A method as claimed in claim 1 wherein step (c) is further defined by searching said data memory for one of said stored input data values comprises a M-path search.

6. A method as claimed in claim 1 wherein steps (c) and (d) are further defined by retrieving said one of said stored input values and said one of said stored output values in parallel.

7. A method as claimed in claim 1 wherein step (b) is further defined by storing said output values in said data memory at respective pointer addresses, and wherein step (d) is further defined by locating said one of said stored output values by moving a pointer relative to said pointer addresses.

8. A method as claimed in claim 7 comprising the step of storing said output values at said pointer addresses in overwriteable fashion.

9. A method as claimed in claim 1 wherein step (c) is further defined by searching said data memory for one of said stored input values which satisfies an identity condition relative to said incoming input value.

10. A method as claimed in claim 1 wherein step (c) is further defined by searching said data memory for one of said stored input values which is identical to or falls within a predetermined deviation from said incoming input value.

11. A method as claimed in claim 1 comprising the step of storing said input values in overwriteable fashion.

12. A method as claimed in claim 1 comprising the step of storing said output values in overwriteable fashion.

13. A method as claimed in claim 1 wherein step (b) comprises storing said input values and said output values in a table in said data memory.

14. A method as claimed in claim 1 wherein step (b) comprises storing said input values and said output values in a matrix in said data memory.

15. A method as claimed in claim 1 comprising the additional step of, for a next incoming data value following said current, incoming data value, searching said data memory in step (c) starting at a last input data value in said data memory searched in step (c) for said current, incoming input value.

16. A method as claimed in claim 1 comprising the additional step of:

after finding said one of said stored input values, setting a ready bit and terminating searching said data memory in step (c).

17. A method as claimed in claim 1 comprising the additional step of:

after finding said one of said stored input values in step (c), triggering an interrupt period.

18. A programmable digital hearing aid comprising:

a hearing aid housing adapted to be worn at an ear:

input/output means in said hearing aid housing for receiving a plurality of successive incoming input data values, including a current, incoming input data value, and for emitting an output data value to a hearing impaired person corresponding to said current, incoming input data value;

data memory means in said hearing aid housing for storing, for a plurality of different stored input values, a plurality of stored output values respectively calculated externally of said hearing aid housing from said stored input values using a selected characteristic function;

first means in said hearing aid housing for searching said data memory for comparing said stored input values with said current incoming input value employing a comparison condition, said comparison condition being selected from the group consisting of one of said stored input values being identical to said incoming input data value, and one of said stored input values being within a predetermined deviation from said incoming input data value;

second means in said hearing aid housing for searching said data memory for, after locating said one of said stored input values, locating one of said stored output values respectively calculated from said one of said stored input values; and processor means in said hearing aid housing, connected to said input/output means, said data memory means, and said first and second means for searching, for supplying said one of said stored output values to said input/output means for emission by said input/output means as said output data value corresponding to said current, incoming input value.

19. A programmable digital hearing aid as claimed in claim 1 wherein said data memory means comprises a table in which said stored input values and said stored output values are contained, and wherein said first means for searching comprises a table pointer element operated by said microprocessor means.

20. A programmable digital hearing aid as claimed in claim 18 wherein said data memory means comprises an overwriteable memory.

21. A programmable digital hearing aid as claimed in claim 18 wherein said data memory means comprises an non-overwriteable memory.

* * * * *